United States Patent [19]

Oberkersch et al.

[11] Patent Number: 5,063,401

[45] Date of Patent: Nov. 5, 1991

[54] WET TREATMENT ARRANGEMENT FOR PHOTOGRAPHIC SHEET CARRIERS

[75] Inventors: Angelika Oberkersch; Anton Pirmann; Helmut Schausberger, all of Munich, Fed. Rep. of Germany

[73] Assignee: Agfa-Gevaert AG, Leverkusen, Fed. Rep. of Germany

[21] Appl. No.: 625,224

[22] Filed: Dec. 10, 1990

[30] Foreign Application Priority Data

Jan. 4, 1990 [DE] Fed. Rep. of Germany ..... 4000114

[51] Int. Cl.[5] ..... G03D 3/08

[52] U.S. Cl. ..... 354/320; 354/322; 354/338; 354/339

[58] Field of Search ..... 354/320, 321, 322, 338, 354/339

[56] References Cited

U.S. PATENT DOCUMENTS 4,256,398 3/1981 Ohtani ..... 354/320

4,272,000 6/1981 Hope et al. ..... 354/339 X 4,345,832 8/1982 Nomura et al. ..... 354/320

4,943,823 7/1990 Uchiyama et al. ..... 354/322

*Primary Examiner*—A. A. Mathews

*Attorney, Agent, or Firm*—Michael J. Striker

[57] ABSTRACT

A wet treatment arrangement for photographic sheet carriers comprises at least one liquid tank having an inlet slot and an outlet slot, and an upper side, at least one transporting roller located in the tank for transporting a sheet carrier from the inlet slot to the outlet slot, a cover part covering the upper side of the tank and provided with guiding surfaces for guiding a sheet carrier from the inlet slot to the transporting roller and from the transporting roller to the outlet slot, and also provided with transfer guiding surfaces, the first mentioned guiding surfaces and the transfer guiding surfaces merging with one another and being formed as guiding ribs extending transversely to a length of the rollers and parallel to one another.

6 Claims, 3 Drawing Sheets

WET TREATMENT ARRANGEMENT FOR PHOTOGRAPHIC SHEET CARRIERS

BACKGROUND OF THE INVENTION

The present invention relates to a wet treatment arrangement for photographic sheet carriers.

More particularly, it relates to such an arrangement of the above type which has at least one liquid tank, at least one transporting roller which transport a sheet carrier from an inlet slot to an outlet slot of one tank and from the outlet slot of the preceding tank to an inlet slot of a following tank by means of transfer guiding surfaces, and cover parts provided for covering the upper surfaces of the tanks from an adjustment space for the wet treatment device, wherein each cover part partially surrounds the upper transporting roller at a distance from it and forms a part of the transfer guiding surfaces.

Arrangements of the above mentioned general type are known in the art. One such arrangement is disclosed for example in the European Patent Document EP 0332028 A2. In this arrangement the sides of the cover parts which face the tank or tanks are formed as smooth surfaces and curved in a substantially circular-arc manner, and a sheet carrier to be guided abuts against the inner surfaces of the cover parts over a greater part of their flat side which faces the cover parts.

SUMMARY OF THE INVENTION

It is an object of the present invention to improve the above mentioned arrangements so that the upper surfaces of the sheet carrier in the region of the guiding surfaces at the side of the cover part are protected.

In keeping with these objects and with others which will become apparent hereinafter, one feature of the present invention resides, briefly stated, in that the guiding surface is provided on each cover part for guiding a sheet carrier from the inlet slot to the transporting roller and from the transporting roller to the outlet slot, as well as the transfer guiding surfaces provided on the cover part merge into one another and are formed as guiding ribs extending transversely to the length of the rollers parallel to one another.

The formation of the guiding surfaces on the cover parts as guiding ribs provides for a very insignificant contact with the corresponding sheet carrier. The guiding ribs have a shape which because of the known curvature properties of the sheet carrier provides for a contact of only the front sheet carrier edge with the guiding ribs and thereby the sheet carrier is deflected. As a result, the danger of scratching for the sheet carrier by the guiding surfaces is completely eliminated. Due to the offset of the guiding ribs of the different cover parts and the tooth-like interengagement of their free ends in the regions between the tanks, a practically complete covering of the upper surface of the whole arrangement from outside is obtained. The whole arrangement is easy to open and to clean and has all advantages of the known arrangements, such as reduction of the bath oxidation and evaporation of liquid in the adjustment space of the arrangement.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

For the sake of clarity only two tanks 1 and 2 for a treatment liquid for a photographic sheet carrier 3 are shown. It is to be understood that the present invention can be utilized with only one tank or more than two tanks.

Figure 1:
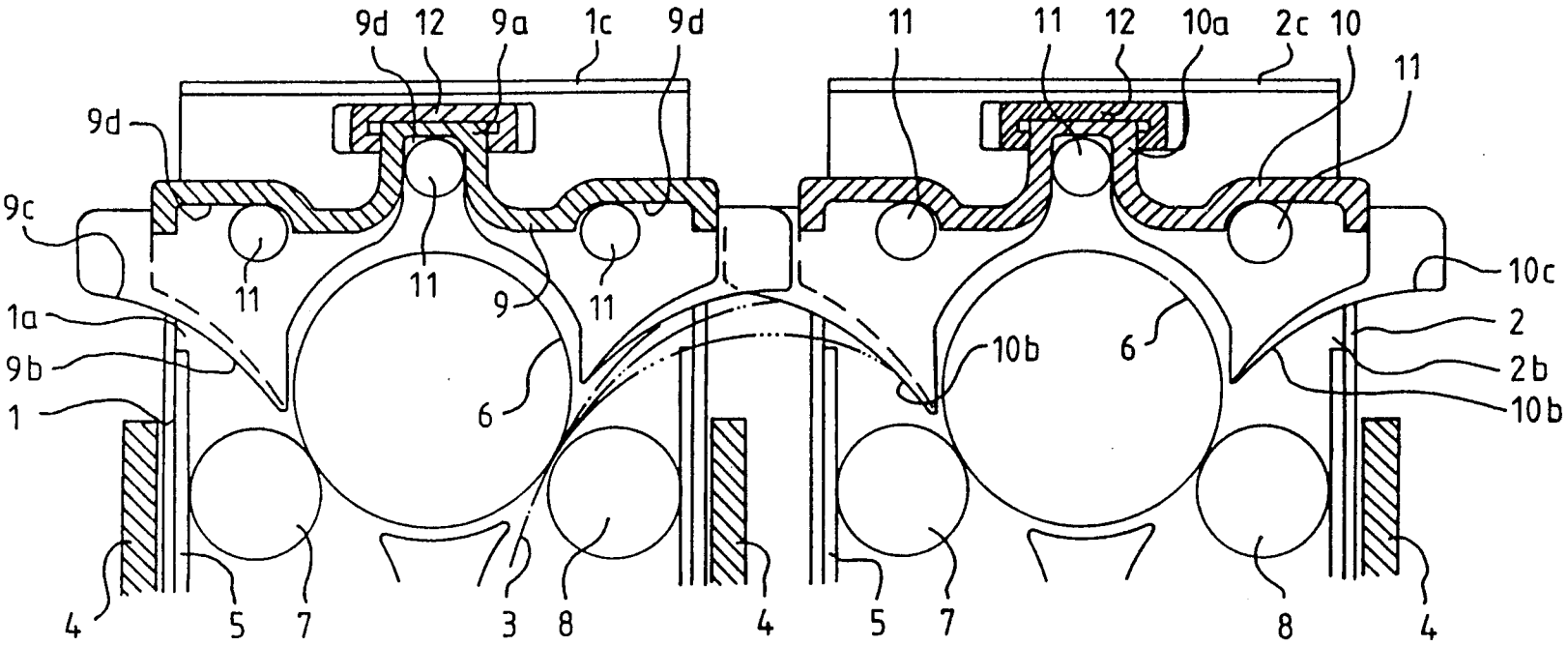
FIG. 1 is a view showing a section of the inventive arrangement for wet treatment of photographic materials, transversely to the axes of a transporting roller.
Figure 2:
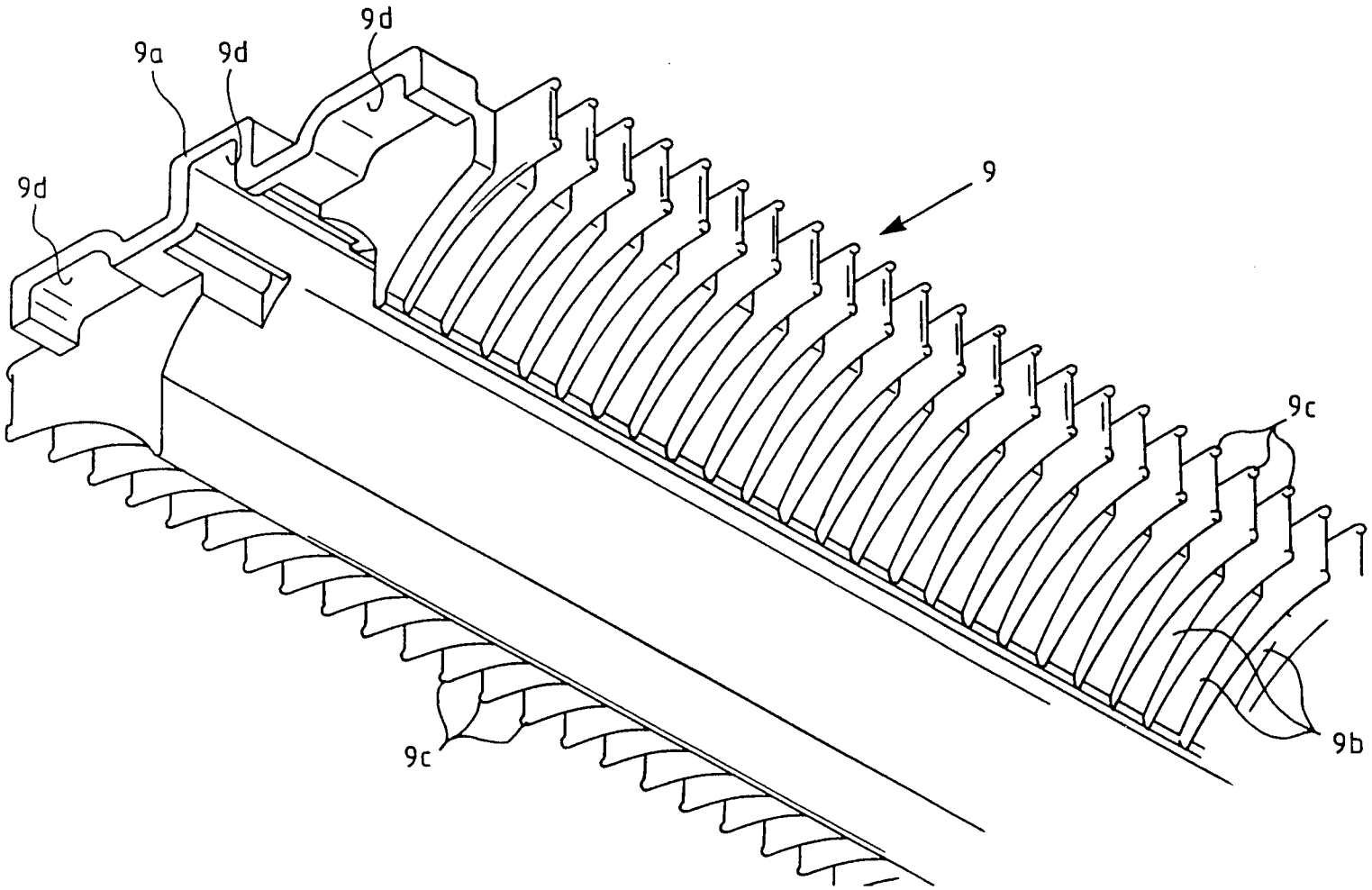
FIG. 2 is a perspective view of a cover part of the inventive arrangement for wet treatment of FIG. 1.
Figure 3:
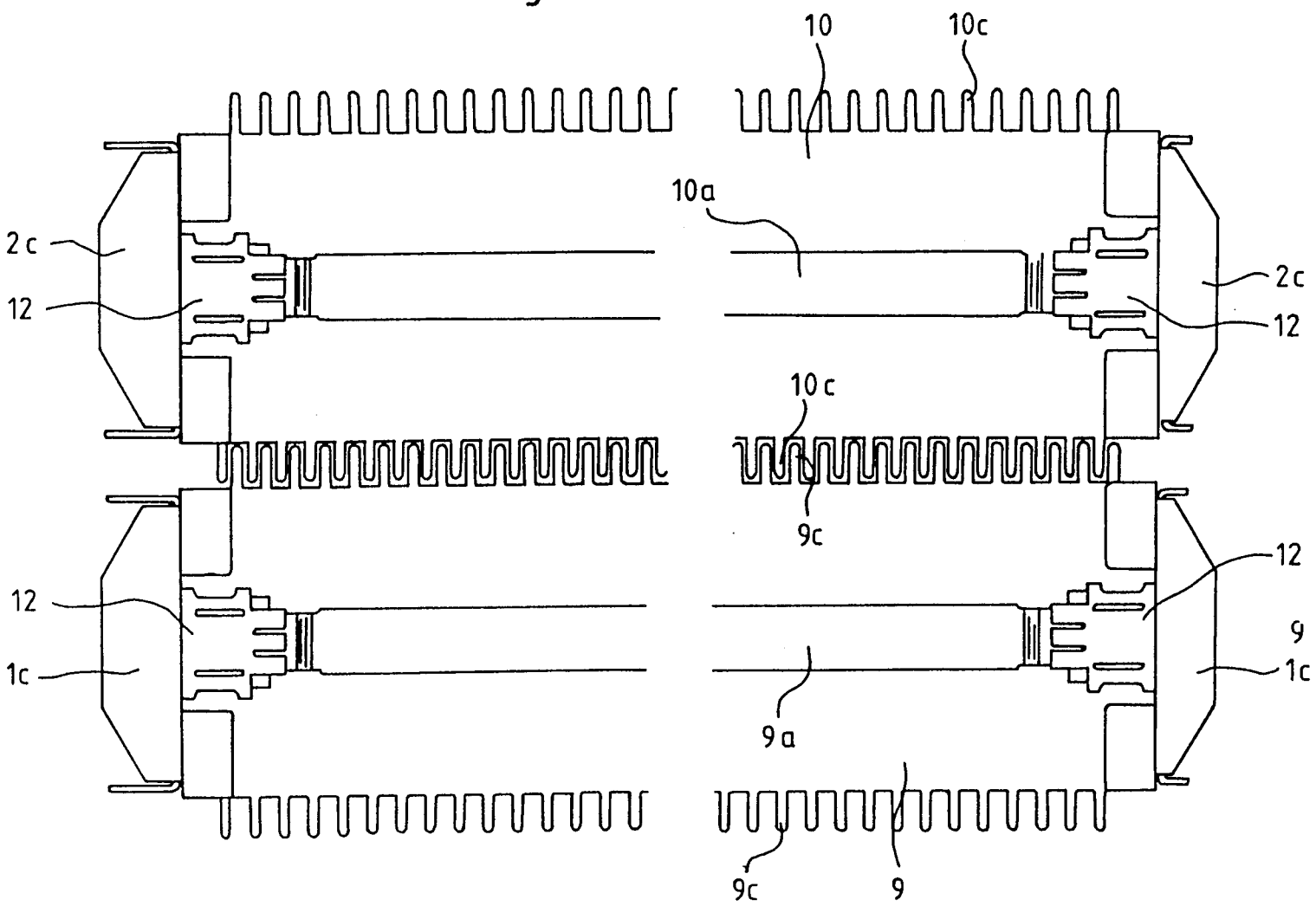
FIG. 3 is a plan view of the inventive arrangement for wet treatment of FIG. 1.

A sheet carrier 3 is shown in FIG. 1 in different positions and identified in dash-dot line as 3, dash-dash double dot line with 3' and dash-triple dot line with 3'' in its three positions. The tanks 1 and 2 are inserted in schematically shown housing compartments 4. A rack 5 is inserted in each tank 1, 2, and transporting rollers are drivingly supported on the rack 5 in a known manner. The transporting rollers include a big inlet drive roller 6 and two rollers 7 and 8 which abut against the roller 6.

A sheet carrier 3 is supplied through an inlet slot 1*a* to the roller pair 6, 7 and after passing of the tank 1 is supplied from the roller pair 6, 8 to an outlet slot 1*b*. After this it is supplied to a second tank 2 through an inlet slot 2*a* and again through the transporting rollers 6, 7 and 6, 8 and in some cases further transporting rollers through an outlet slot 2*b*. Each tank 1 or 2 can be covered with a cover part 9 and 10 respectively. The cover part 9 or 10 has an edge profile provided with troughs 9*d* so that its ends can be placed on pins 11. The pins 11 are mounted on the end walls 1*c*, 2*c* of the tanks and extend inwardly. A slider 12 is supported on the end walls 1*c*, 2*c* of each tank. It is displaceable over an outwardly projecting rib 9*a* and 10*a* on each cover part, for locking the cover parts 9, 10 in their use position.

The inner surfaces of the cover parts 9 and 10 are formed as guiding surfaces both for guiding a sheet carrier through the inlet slot 1*a* to the first roller pair 6, 7, and also for guiding after the outlet rollers 6, 8 through the outlet slot 1*b*, and in the inlet slot 2*a* to the rollers 6, 7 of the tank 2 and from the rollers 6, 8 to the outlet slot 2*b*. In order to prevent abutment of a sheet carrier 3 with its complete upwardly oriented flat surface against the guiding surfaces, the guiding surfaces on the cover parts 9 and 10 are formed as guiding ribs 9*b* and 10*b* which extend transverse to the length of the rollers 6 and parallel to one another. A design which is symmetrical to the longitudinal center plane of the cover parts 9 and 10 is important for the cover parts made of synthetic plastic material for the injection molding production of these parts. The guiding rib parts 9*c* and 10*c* connected with the guiding ribs 9*b* and 10*b* and guiding the sheet support 3 during its insertion into one tank or its transfer between two tanks is connected continuously to the guiding rib 9*b* and 10*b* as transfer guiding ribs.

It is a special feature of the present invention that the cover parts 9 and 10 located near the guiding ribs 9*b*, 9*c*, 10*b*, 10*c* are offset relative to the roller length with respect to one another so that the cover parts 9 and 10 located near to the transfer guiding rib parts 9*c* and 10*c* engage in one another in the form of a toothing in the position in which they are placed on the tanks 1 and 2. Therefore, despite the arrangement of the guiding ribs instead of closed guiding surfaces in the transition region between the tanks 1 and 2, a good covering of the total arrangement is provided.

A further specific feature of the guiding ribs 9*b*, 9*c*, 10*b*, 10*c* is that the shape of the guiding ribs deviates from the shape of the curvature of a moved sheet support 3 during the transportation so that only front sheet support edge as considered in the movement direction runs along, while the flat side of the sheet support does not abut against them. This is achieved in that, depending on sheet support materials and sheet support sizes to be used in an arrangement, for a predetermined roller arrangement its natural curvature during transportation is known or detectable. The curvature of the guiding ribs 9*b*, 9*c*, 10*b*, 10*c* must be then smaller than the curvature of the sheet support produced during abutting of the sheet support front edge against the guiding ribs. This is clearly shown in FIG. 1, in which three positions 3, 3' and 3'' of a sheet support guided by the guiding ribs 9*c*, 10*c* from tank 1 into tank 2 are illustrated.

It is clear that the cover parts 9, 10 can be easily removed from the arrangement including the parts 1, 2, 4. By removing the rack 5, the arrangement is very simple to clean. The cover parts 9, 10 are simple to produce of synthetic plastic material and together cover the whole arrangement. It is clear that the arrangement with a greater number of tanks is completely covered with correspondingly formed further cover parts, and the utilization of a cover part per each tank leads to smaller more convenient parts. Naturally, the guiding ribs of further cover parts must also be offset relative to one another in the above described manner as shown for the cover parts 9, 10 and described hereinabove.

It will be understood that each of the elements described above, or two or more together, may also find a useful application in other types of constructions differing from the types described above.

While the invention has been illustrated and described as embodied in a wet treatment arrangement for photographic sheet carriers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A wet treatment arrangement for photographic sheet carriers, comprising at least one liquid tank having an inlet slot and an outlet slot; and an upper side; at least one transporting roller located in said tank for transporting a sheet carrier from said inlet slot to said outlet slot; a cover part covering said upper side of said tank and provided with guiding surfaces for guiding a sheet carrier from said inlet slot to said transporting roller and from said transporting roller to said outlet slot, and also provided with transfer guiding surfaces, said first mentioned guiding surfaces and said transfer guiding surfaces merging with one another and being formed as guiding ribs extending transversely to a length of said rollers and parallel to one another.

2. A wet treatment arrangement as defined in claim 1, wherein said guiding ribs of said cover parts located adjacent to one another are offset relative to one another with respect to the length of said rollers so that said ribs which form said transfer guiding surfaces in the neighboring cover parts engage with one another in form of a toothing with said cover parts placed on said tanks.

3. A wet treatment arrangement as defined in claim 1, wherein said guiding ribs have a shape which deviates from a curved shape of the moved sheet support so that only a front sheet support edge is considered in a movement direction runs along them.

4. A wet treatment arrangement as defined in claim 1, wherein said cover parts have ends which in direction of roller lengths extend outwardly beyond said guiding ribs and have inner surfaces provided with troughs.

5. A wet treatment arrangement as defined in claim 4, wherein said tank has tank walls which surround said rollers and are provided with projections formed so that said troughs can be placed on said projections.

6. A wet treatment arrangement as defined in claim 4, wherein said tank has tank walls which surround said rollers and are provided with projections formed so that said troughs can be locked on said projections.

* * * * *